US008631965B2

(12) United States Patent
Leasure

(10) Patent No.: US 8,631,965 B2
(45) Date of Patent: Jan. 21, 2014

(54) CONTAINER WITH REMOVABLE SIDE PANELS

(76) Inventor: Gary Leasure, Jacksonville, FL (US)

( * ) Notice: Subject to any disclaimer, the term of this patent is extended or adjusted under 35 U.S.C. 154(b) by 0 days.

(21) Appl. No.: 13/525,980

(22) Filed: Jun. 18, 2012

(65) Prior Publication Data

US 2012/0318811 A1 Dec. 20, 2012

Related U.S. Application Data

(60) Provisional application No. 61/520,938, filed on Jun. 17, 2011.

(51) Int. Cl.

| | |
|---|---|
| ***B65D 6/00*** | (2006.01) |
| ***B65D 8/14*** | (2006.01) |
| ***B65D 8/04*** | (2006.01) |
| ***B65D 90/02*** | (2006.01) |
| ***B65D 19/00*** | (2006.01) |
| ***A47B 47/00*** | (2006.01) |

(52) U.S. Cl.
USPC ..... 220/682; 220/4.28; 220/4.31; 220/4.33; 220/660; 206/600; 211/189; 211/192

(58) Field of Classification Search
USPC ..... 206/600; 220/4.31, 692, 4.28, 4.33, 220/693, 682, 660; 211/189, 190, 191, 192, 211/204, 206, 123
See application file for complete search history.

(56) References Cited

U.S. PATENT DOCUMENTS

| | | | | | |
|---|---|---|---|---|---|
| 2,669,373 | A | * | 2/1954 | Coit, Jr. | 220/668 |
| 2,720,996 | A | * | 10/1955 | Anderson | 220/1.5 |
| 2,898,122 | A | * | 8/1959 | Beckner | 280/28.12 |
| 3,883,026 | A | * | 5/1975 | Selz | 220/6 |
| 3,981,410 | A | * | 9/1976 | Schurch | 220/6 |
| 4,150,762 | A | * | 4/1979 | Brunette | 220/485 |
| 4,199,069 | A | * | 4/1980 | Talarico | 211/194 |
| 4,662,532 | A | * | 5/1987 | Anderson et al. | 220/7 |
| 5,595,305 | A | * | 1/1997 | Hart | 206/600 |
| D402,037 | S | * | 12/1998 | Hofstad | D34/38 |
| 5,918,750 | A | * | 7/1999 | Jackson | 211/189 |
| 6,164,476 | A | * | 12/2000 | Rene et al. | 220/4.31 |
| 6,170,686 | B1 | * | 1/2001 | Flores | 220/4.33 |
| 6,179,137 | B1 | * | 1/2001 | Talarico | 211/194 |
| 6,442,909 | B2 | * | 9/2002 | Waalkes et al. | 52/239 |
| 6,691,885 | B2 | * | 2/2004 | Brown | 220/7 |
| 6,981,605 | B2 | * | 1/2006 | Kasuya et al. | 220/6 |
| D609,425 | S | * | 2/2010 | Svedberg | D34/38 |
| 7,757,876 | B1 | * | 7/2010 | Ditter | 220/4.31 |

* cited by examiner

*Primary Examiner* — Steven A. Reynolds
*Assistant Examiner* — Javier A Pagan
(74) *Attorney, Agent, or Firm* — Thomas C. Saitta

(57) ABSTRACT

A container having removable side panels and spacer inserts, the spacer inserts disposed within the gap between adjacent side panels, whereby said side panels are raised to remove them from the container and wherein the spacer inserts preclude removal of a lower side panel unless the adjacent upper side panel is raised sufficient distance to remove the spacer insert.

15 Claims, 5 Drawing Sheets

CONTAINER WITH REMOVABLE SIDE PANELS

This application claims the benefit of U.S. Provisional Patent Application Ser. No. 61/520,938, filed Jun. 17, 2011, the disclosure of which is incorporated herein by reference.

BACKGROUND OF THE INVENTION

This invention relates generally to the field of containers or crates, typically comprising a pallet-type bottom, and more particularly to such containers that have multiple removable side panels on at least one side, wherein the side panels can be locked for security and unlocked to allow removal of the side panels from the container for access to the interior of the container.

Containers or crates with removable doors or side panels are well known, the side panels being disposed one atop the other in a single plane. The side panels are typically rectangular in configuration and the container is provided with a plurality of horizontal shelve members. The number of side panels is typically related to the number of shelves, and the overall size of the removable side panels is limited such that they are relatively easy to remove and handle. When it is desirable to lock the side panels to prevent unauthorized removal of the side panels in order to protect the contents of the container, there are two common systems utilized. The side panels are usually secured by locking them to another structural component of the container, such as one of the vertical post or pillar members.

A first known system requires side panels that must be removed in a specific order, usually from top to bottom, in order to remove a particular side panel. With this system, only the first removable panel needs to be locked, usually the uppermost panel, since the remaining panels cannot be removed until the first panel is removed. While having to provide only a single lock may be advantageous, the need to remove multiple panels to remove a single lower panel is inconvenient. An example of such a system can be seen in U.S. Pat. No. 6,164,476, issued to Rene et al.

A second system allows each side panel to be individually removed without requiring removal of any of the remaining side panels. This system is most convenient with regard to access, but is not optimal because it requires that each panel be independently locked, thereby increasing the cost of manufacture of the container.

It is an object of this invention to provide a container having removable side panels, the side panels being lockable to prevent unauthorized access, wherein the container can be converted to allow multiple modes of access, such that each of the individual side panels is removable independently or certain side panels are removable only if one or more other panels are first removed.

SUMMARY OF THE INVENTION

The invention is a container or crate, preferably being readily collapsible for storage and transport, having at least two removable side panels positioned one above the other, wherein the container can be converted into various arrangements such that each of the individual side panels is removable either independently or is removable only if one or more other panels are first removed. The side panels comprise laterally projecting hooks having notches which engage vertical slots disposed in the corner or interior pillar members. With the downwardly disposed hook positioned in the pillar slot, a laterally translatable side panel locking member can be inserted into the open portion of the slot, thereby preventing removal of the side panel from the pillar since the panel cannot now be raised high enough for the notch in the hook to clear the slot. A lock, security cable or the like is attachable to the side panel locking member to prevent its removal from the slot. A gap is provided between each adjacent side panel, the gap being greater than the depth of the notch in the hooks. To remove the side panel from pillars and the container, the locking member is withdrawn from the slot, the side panel is lifted upward and shifted to each side to allow clearance of the hooks from the slots. Because of the gap between side panels, an adjacent side panel will not interfere with the removal of an individual side panel. In this configuration for the container, each side panel must be locked individually.

To convert the container into a configuration wherein a particular side panel cannot be removed without first removing the side panel immediately above it, spacer inserts are provided. The spacer inserts are positioned in the gaps between adjacent side panels. The spacer inserts preclude a side panel from vertical movement and removal, such that with a spacer insert in place, the side panel cannot be raised a sufficient distance for clearance of the hook notch from the slot in the post. Only upon removal or repositioning of the spacer insert to clear the gap can the individual side panel be removed. While the spacer inserts may be unconnected to other components of the container, it is preferred that the spacer inserts be configured and disposed such that they are received within spacer slots located on one or more of the pillars, the spacer inserts being so configured such that they may be positioned in an extended use position or in a recessed non-use position. In this manner, the user can alter the functionality of the container as to which side panels are to be individually removable and which are to be retained until removal of an adjacent side panel.

BRIEF DESCRIPTION OF THE DRAWINGS

FIG. 5 shows the spacer insert of FIG. 4 positioned in the gap between adjacent side panels.

DETAILED DESCRIPTION OF THE INVENTION

Figure 1:
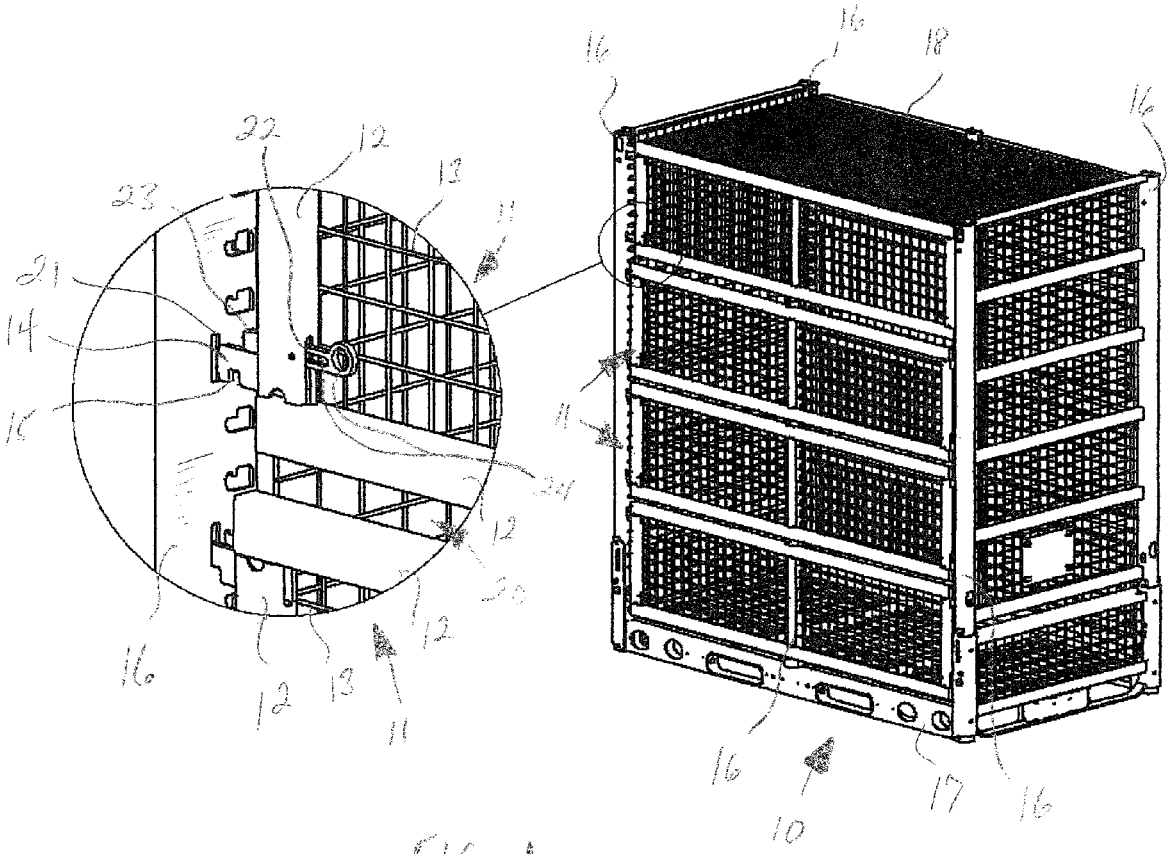
FIG. 1 is an illustration of a four panel container with a detailed view of the side panel hook and locking member.

With reference to the drawings, the invention will now be described in detail with regard for the best mode and preferred embodiment. In a broad sense the invention is a container or crate, preferably of the pallet-type such that the container may be easily moved, and also preferably of the collapsible-type such that the elements of the container may be taken apart and stored in a much smaller volume for storage and transport.

The invention is a container or crate 10 having at least one side with at least two removable doors or side panels 11 positioned one above the other in a single plane, two adjacent side panels 11 defining a horizontally elongated gap 20, wherein the container 10 can be assembled in various arrangements such that each of the individual side panels 11 is removable either independently or is removable only if one or more other panels 11 are first removed. The container 10 comprises a plurality of vertical post or pillar members 16 extending from the corners of a container floor or base member 17, and also possibly at interior positions on the sides of the base member 17. A container top member 18 is attached to the tops of the pillar member 16. The base member 17 and top member 18 may be composed of a solid sheet material, a metal mesh or the like extending between rigid frame members in known manner. The pillar members 16 are preferably square or rectangular profile metal members and are provided with vertical slots 21 located in opposition to receive the side panels 11.

The side panels 11 typically comprise a rigid rectangular frame 12 supporting a barrier member 13, such as a solid sheet material or metal mesh. The side panels 11 further comprise projecting hook members 14 extending laterally from each end of the frame 12, preferably two hook members 14 on each end, the hook members 14 having vertical notches 15 disposed on their lower edge such that the hook members 14 face downward, the hook members 14 and notches 15 being configured to engage the vertical slots 21 disposed in the corner and/or interior pillar members 16. The depth of the notches 15 is less than the vertical dimension of the gap 20 between adjacent side panels 11 such that in the basic configuration each side panel 11 can be raised and removed independently of the other side panels 11. To assemble the side panel 11 to the container 10, the hook members 14 on one end are inserted deeply into the vertical pillar slots 21 on one pillar member 16, thereby providing sufficient clearance for the opposing hook members 14 to be aligned with the pillar slots 21 in the opposing pillar member 16. Translating the side panel 11 laterally then aligns the notches 15 of the hook members 14 within the pillar members 16 such that the side panel 11 drops downward and is secured against lateral movement by the body of the pillar members 16. To remove the side panel 11, the panel 11 is raised to free the hook members 14 from the bodies of the pillar members 16, moved laterally such that the hook members 14 on one end clear the pillar member 16 a sufficient distance such that the end of the side panel 11 can be pulled forward slightly out of alignment with the pillar member 16, then shifted in the opposite lateral direction to free the hook members 14 on the other end of the side panel 11 from the other pillar member 16.

With the downwardly disposed hook members 14 positioned in the pillar slots 21, a laterally translatable side panel locking member 22 mounted in the side panel 11 and positioned above each hook member 14, as shown in FIG. 1, can be inserted into the open portion of the pillar slot 21, thereby preventing upward movement and removal of the side panel hook member 14 from the pillar member 16 since the panel 11 cannot be raised high enough for the notch 15 to clear the slot 21. The locking member 22 comprises a bolt body 23 that occupies the pillar slot 21 and a locking aperture 24, such as a slot or eyelet. A lock, security cable or the like is attachable to the side panel locking member 22 to prevent its withdrawal from the slot pillar 21.

The container 10 and side panels 11 are sized and configured to provide a horizontally elongated gap 20 between each adjacent side panel 11, the vertical dimension of the gap 20 being greater than the depth of the notch 15 in the hook members 14. To remove the side panel 11 from pillars 16, the bolt bodies 23 of the locking members 22 are withdrawn from the pillar slots 21, the side panel 11 is lifted upward and shifted to each side to allow clearance of the hook members 14 from the pillar slots 21. Because of the size of the gap 20 between adjacent side panels 11, an adjacent side panel 11 will not interfere with or prevent the removal of an individual side panel 11. In this basic configuration for the container 10, each side panel 11 must be locked individually if the contents of the container 10 are to be secured.

To convert the container 10 into a configuration wherein a particular side panel 11 cannot be removed without first removing the side panel 11 immediately above or superior to it, spacer inserts 30 are provided. One or more of the spacer inserts 30 are positioned in a gap 20 between adjacent side panels 11 when it is desired to preclude removal of a lower side panel 11 without first removing the side panel 11 immediately above. The spacer inserts 30 preclude a side panel from vertical movement and removal, such that with a spacer insert 30 in place, the side panel 11 cannot be raised a sufficient distance for clearance of the hook notches 15 from the slots 21 in the pillar members 16. Only upon removal or repositioning of the spacer insert 30 into a non-active or recessed position to clear the gap 20 between adjacent side panels 11 can the lower individual side panel 11 be removed from the container 10. Removal or repositioning of the spacer insert 30 within a gap 20 can only be accomplished when the superior side panel 11 is removed from the container 10 or at least raised a sufficient distance such that the gap 20 is sufficiently wide to allow for removal or recessing of the spacer insert 30. The spacer insert 30 comprises a main body 31, the height of the main body 31 being preferably substantially equal to the vertical dimension of the gap 20 so as to substantially fill the gap 20 when in the active position. At a minimum, the height of the main body 31 must be such that the distance between the main body and the bottom of the side panel 11 immediately above the spacer insert 30 is less than the depth of the notches 15. In other terms, the height of the main body 31 must be greater than the difference between the vertical dimension of the gap 20 and the depth of the notches 15.

Figure 2:
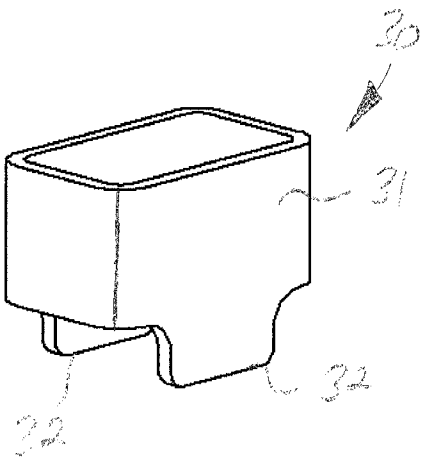
FIG. 2 is an illustration of one embodiment of the spacer insert, the spacer insert being non-attached to and removable from the container.
Figure 3:
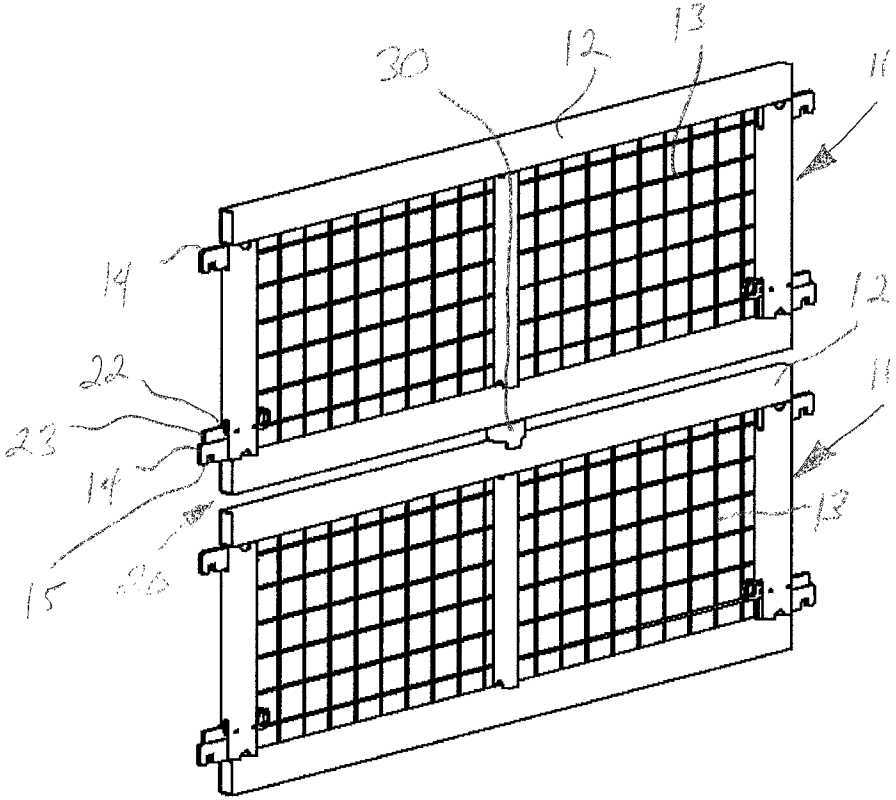
FIG. 3 shows the spacer insert of FIG. 2 positioned in the gap between adjacent side panels, such that the lower panel cannot be removed without first removing the upper panel.

A basic embodiment of the spacer insert 30 is shown in FIGS. 2 and 3. The spacer insert 30 comprises a main body 31 and a pair of extension tab members 32, the tab members 32 being spaced apart a slightly greater distance than the depth of the side panel frame 12. With the lower side panel 11 mounted within the pillar members 16, one or more spacer inserts 30 are set atop the lower side panel 11 and the upper adjacent side panel 11 is put into place. With the upper side panel 11 locked so that vertical movement is precluded, the lower side panel 11 cannot be raised since the gap 20 is filled by the spacer insert 30, which cannot be removed since the pair of extension tab members 32 reside to either side of the side panel frame 12, the separation distance of the extension tab members 32 being greater than the depth of the side panel 11. Only upon removal of the upper side panel 11 can the lower side panel 11 be raised and removed from the container 10.

Figures 4, 6:
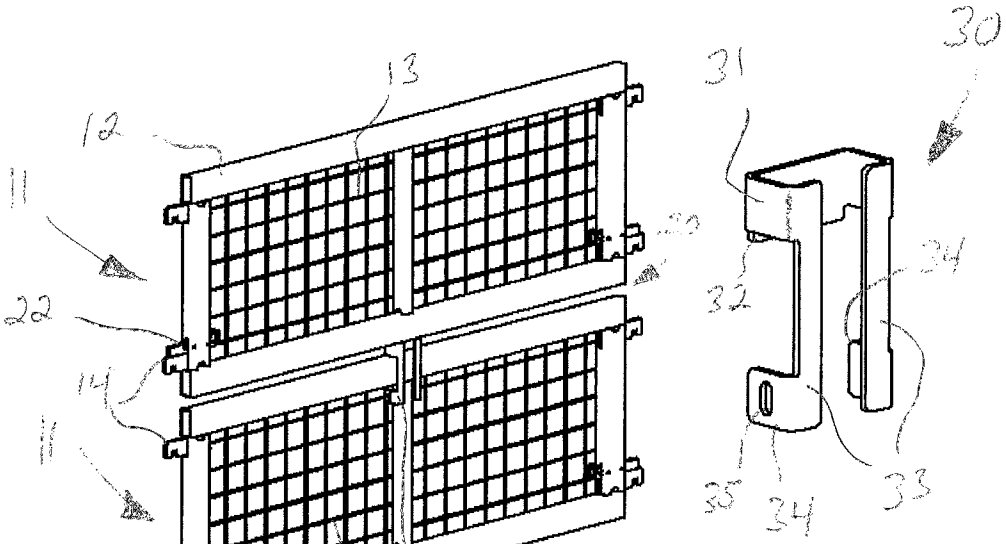
FIG. 4 is an illustration of an alternative embodiment of the spacer insert, which is pivotally attachable to the container.
FIG. 6 is an illustration of a preferred embodiment of the spacer insert, the spacer insert being repositionable from an active position extending from a pillar to a non-active position recessed on and within the pillar.
Figure 6:
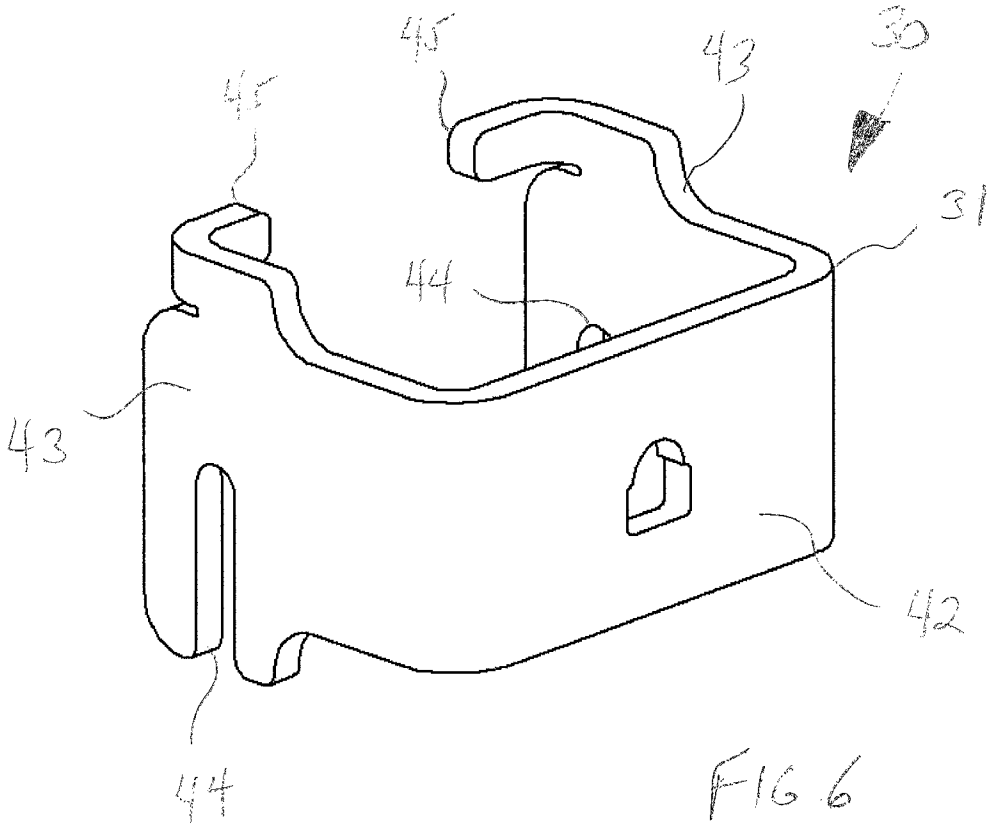

An alternative embodiment for the spacer insert 30 is shown in FIGS. 4 and 5. In this embodiment, the spacer insert 30 comprises a main body 31 with a single tab member 32, a pair of elongated leg members 33, a pivot flange 34 connected to each leg member 33 and pivot slots 35 disposed in the pivot flanges 34. The spacer insert 30 is mounted onto an interior pillar member 16, the interior pillar member 16 being provided with mounting posts (not shown). The pivot slots 35 receive the posts and the spacer insert can be pivoted from a non-active or neutral position with the main body 31 not located within gap 20 to an active position with the main body 31 located in the gap 20. In the active position, with the upper side panel 11 locked in place, the main body 11 fills the gap 20 so that the lower side panel 11 cannot be raised and removed, the tab member 32 preventing removal of the main body 31 without raising the upper side panel 11.

Figure 7:
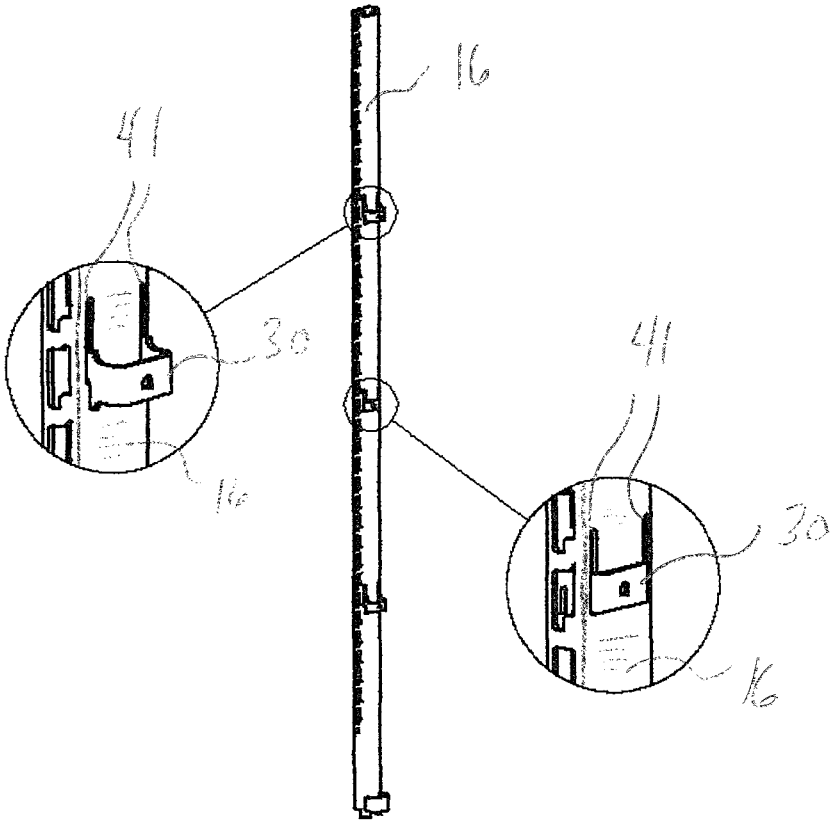
FIG. 7 illustrates the spacer insert of FIG. 6 in both the active extended position and the non-active recessed position.

FIGS. 6 and 7 illustrate a preferred embodiment of the spacer insert 30 and the pillar members 16 of container 10. In this embodiment at least one pillar member 16, preferably an interior pillar member 16, is provided with a pair of vertical spacer slots 41. The main body 31 of the spacer insert 30 is generally U-shaped, comprising an exterior face 42 and a pair of rearwardly extending side flanges 43, the separation distance between the side flanges 43 matching the separation distance of the spacer slots 41. An insert notch 44 is positioned on the underside of each of the side flanges 43. With this configuration the side flanges 43 of the spacer insert 30 can be fully inserted through the spacer slots 41 and into the pillar member 16, such that the face 42 of the spacer insert abuts or is closely spaced to the pillar member 16. This is the recessed or non-active position for the spacer member 30, since the main body 31 will not positioned in the gap 20 between adjacent side panels 11. A pair of locking tabs 45 may be provided, the locking tabs 45 being bent inward after insertion as shown in FIG. 6 to preclude removal of the spacer insert 30 from the spacer slots 41. To utilize the spacer insert 30, once a lower side panel 11 is in place between the pillar members 16, the spacer insert 30 is raised upward and brought forward to align the insert notches 44 with the wall of the pillar member 16, then lowered such that the wall of the pillar member 16 is received within the insert notches 44 and movement of the spacer insert 30 in any other direction other than vertical is precluded. With the upper side panel 11 locked in place, the main body 31 of the spacer insert 30 occupies the gap 20 between the adjacent side panels 11 and prevents the raising and removal of the lower side panel 11 until the upper panel 11 is removed (or raised a sufficient distance) such that the spacer insert 30 can be lifted to clear the insert notches 44 and pushed from the extended position into the recessed position.

In this manner, the user can alter the functionality of the container 10 as to which side panels 11 are to be individually removable and which are to be retained until removal of an adjacent side panel. With reference to a container having four side panels 11 on one side, the container 10 may be assembled such that each side panel 11 is independently removable by not positioning any spacer inserts 30 in the gap 20 between adjacent side panels 11, in which case each side panel 11 must be individually locked. The container 10 may be assembled with spacer inserts located in each of the three gaps 20 between adjacent side panels 11, in which case raising and removal of any lower side panel 11 requires removal or raising of all the side panels 11 situated above the side panel 11 to be removed. In this configuration a lock on the uppermost side panel 11 secures all of the lower side panels 11 as well. In still other configurations, the container 10 may be provided with a spacer insert 30 positioned in one or two of the gaps 20 in various combinations, in which case the side panel 11 above the spacer insert 30 must be removed or raised in order to free the side panel 11 located below the spacer insert 30. Thus, the container 10 as described can be configured by the user in multiple configurations depending on the needs of the user with regard to securing particular side panels 11.

It is understood and contemplated that equivalents and substitutions for certain elements described above may be obvious those of skill in the art, and therefore the true scope and definition of the invention is to be as set forth in the following claims.

I claim:

1. A container comprising removable side panels mounted between pillar members, said side panels being oriented vertically in the same plane whereby for any two adjacent side panels one said side panel is a lower side panel and the other said side panel is an upper side panel, and further whereby said two adjacent side panels define a gap between said lower side panel and said upper side panel, wherein each said side panel is removable from said pillar members by raising said side panel;

said container further comprising at least one spacer insert positioned within said gap, said spacer insert comprising a main body sized to substantially fill said gap, whereby said spacer insert is only movable from said gap by raising or removing said upper panel, and such that said lower side panel is only removable from said container upon raising or removing said upper side panel;

said container further comprising pairs of spacer slots located on said pillar members; wherein said spacer insert comprises a main body, an external face, a pair of side flanges extending from said external face, and an insert notch disposed in each said side flange, wherein said side flanges are received within said spacer slots.

2. A container comprising vertical pillar members extending between a base member and a top member, a plurality of removable side panels, said side panels oriented vertically one above the other such that each adjacent pair of said side panels defines a lower side panel and an upper side panel, and a gap between each adjacent pair of said side panels, said gap having a vertical dimension;

each of said side panels comprising a frame defining a top, a bottom and a pair of ends, a barrier member extending across said frame, and downward facing hook members extending from said ends of said side panel, each of said hook members comprising a notch having a depth;

at least two of said pillar members comprising vertical slots sized to receive said hook members;

wherein said depth of said notches is less than the vertical dimension of said gap between each said adjacent pair of said side panels;

a spacer insert positionable within at least one said gap, said spacer insert comprising a main body having a height greater than the difference between the vertical dimension of said gap and said depth of said notches, whereby with said spacer insert positioned within said at least one said gap, said lower side panel cannot be raised a sufficient distance to remove said hook members from said vertical slots unless said upper side panel is raised a sufficient distance to remove said spacer insert from within said gap.

3. The container of claim 2, wherein said spacer insert further comprises a pair of extension tab members extending from said main body, said extension tab members having a separation distance wider than said side panel.

4. The container of claim 2, wherein said spacer insert further comprises an extension tab member and leg members extending from said main body, a side flange connected to each said leg member, and a slot disposed in each said side flange.

5. The container of claim 4, wherein said spacer insert is movable between an active position with said main body positioned in said gap and a non-active position with said main body removed from said gap.

6. The container of claim 2, said container further comprising pairs of spacer slots located on at least one said pillar member; wherein said spacer insert further comprises an external face, a pair of side flanges extending from said external face, and an insert notch disposed in each said side flange, wherein said side flanges are received within said spacer slots.

7. The container of claim 6, wherein said spacer insert is movable between a recessed position with said side flanges fully inserted into said spacer slots and an extended position with said external face spaced from said pillar member and said insert notches receiving said pillar member.

8. The container of claim 2, further comprising locking members positioned above said hook members, each of said locking members comprising a bolt body insertable into said pillar slots when said hook members are disposed within said pillar slots, such that said bolt body precludes vertical movement of said side panel sufficient to remove said side panel from said container.

9. A container comprising vertical pillar members extending between a base member and a top member, a plurality of removable side panels, said side panels oriented vertically one above the other such that adjacent said side panels define a lower side panel and an upper side panel, and a gap between each adjacent pair of said side panels, said gap having a vertical dimension;

each of said side panels comprising a frame defining a top, a bottom and a pair of ends, a barrier member extending across said frame, and downward facing hook members extending from said ends of said side panel, each of said hook members comprising a notch having a depth;

at least two of said pillar members comprising vertical slots sized to simultaneously receive said hook members and locking members;

said locking members positioned above said hook members, each of said locking members comprising a bolt body insertable into said vertical slots when said hook members are disposed within said vertical slots, such that said bolt body precludes vertical movement of said side panel sufficient to remove said side panel from said container;

wherein said depth of said notches is less than the vertical dimension of said gap between each said adjacent pair of said side panels;

a movable spacer insert positionable between an active position located within at least one said gap and a non-active position located out of said at least one gap, said spacer insert comprising a main body having a height greater than the difference between the vertical dimension of said gap and said depth of said notches, whereby with said spacer insert positioned within said at least one said gap, said lower side panel cannot be raised a sufficient distance to remove said hook members from said vertical slots unless said upper side panel is raised a sufficient distance to remove said spacer insert from within said gap.

10. The container of claim 9, wherein said spacer insert further comprises a pair of extension tab members extending from said main body, said extension tab members having a separation distance wider than said side panel.

11. The container of claim 9, wherein said spacer insert further comprises an extension tab member and leg members extending from said main body, a side flange connected to each said leg member, and a slot disposed in each said side flange.

12. The container of claim 9, said container further comprising pairs of spacer slots located on at least one said pillar member; wherein said spacer insert further comprises an external face, a pair of side flanges extending from said external face, and an insert notch disposed in each said side flange, wherein said side flanges are received within said spacer slots.

13. The container of claim 12, wherein in said non-active position said side flanges are fully inserted into said spacer slots and in said active position said external face is spaced from said pillar member and said insert notches receive said pillar member.

14. The container of claim 12, further comprising at least one interior pillar member, and wherein said spacer slots are located on said at least one interior pillar member.

15. The container of claim 13, further comprising at least one interior pillar member, and wherein said spacer slots are located on said at least one interior pillar member.

* * * * *